US008132493B1

(12) United States Patent
Adams

(10) Patent No.: US 8,132,493 B1
(45) Date of Patent: Mar. 13, 2012

(54) HYBRID TILE METAL MATRIX COMPOSITE ARMOR

(75) Inventor: Richard Adams, Bolton, MA (US)

(73) Assignee: CPS Technologies, Norton, MA (US)

( * ) Notice: Subject to any disclaimer, the term of this patent is extended or adjusted under 35 U.S.C. 154(b) by 173 days.

(21) Appl. No.: 12/220,147

(22) Filed: Jul. 22, 2008

Related U.S. Application Data

(60) Provisional application No. 61/005,127, filed on Dec. 3, 2007.

(51) Int. Cl.
*F41H 5/02* (2006.01)

(52) U.S. Cl. ..... 89/36.02; 89/908

(58) Field of Classification Search ..... 89/36.01, 89/36.02, 36.04, 36.05, 36.07, 903, 904, 89/36.11, 36.12; 2/2.5
See application file for complete search history.

(56) References Cited

U.S. PATENT DOCUMENTS 5,792,974 A * 8/1998 Daqis et al. ..... 89/36.02
6,895,851 B1 * 5/2005 Adams et al. ..... 89/36.02
6,955,112 B1 10/2005 Adams et al.
7,490,539 B2 * 2/2009 Ma ..... 89/36.02
2009/0090236 A1 * 4/2009 Misencik et al. ..... 89/36.02
2010/0071537 A1 * 3/2010 Weber et al. ..... 89/36.02

OTHER PUBLICATIONS

PCT/DE07/01921.*

* cited by examiner

*Primary Examiner* — Bret Hayes
*Assistant Examiner* — Reginald Tillman, Jr.

(57) ABSTRACT

A lightweight armor system may comprise multiple reinforcement materials layered within a single metal matrix casting. These reinforcement materials may comprise ceramics, metals, or other composites with microstructures that may be porous, dense, fibrous or particulate. Various geometries of flat plates, and combinations of reinforcement materials may be utilized. These reinforcement materials are infiltrated with liquid metal, the liquid metal solidifies within the material layers of open porosity forming a dense hermetic metal matrix composite armor in the desired product shape geometry. The metal infiltration process allows for metal to penetrate throughout the overall structure extending from one layer to the next, thereby binding the layers together and integrating the structure.

28 Claims, 15 Drawing Sheets

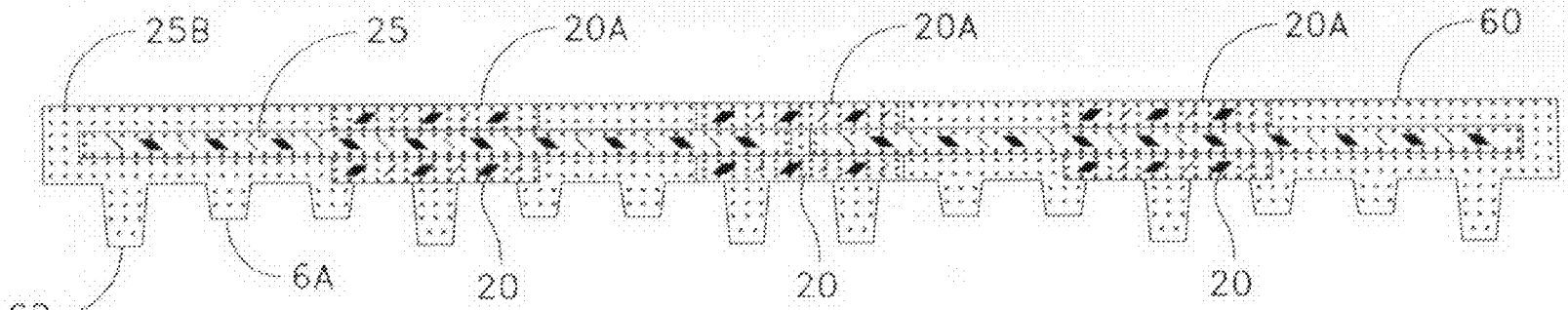
FIG. 6A
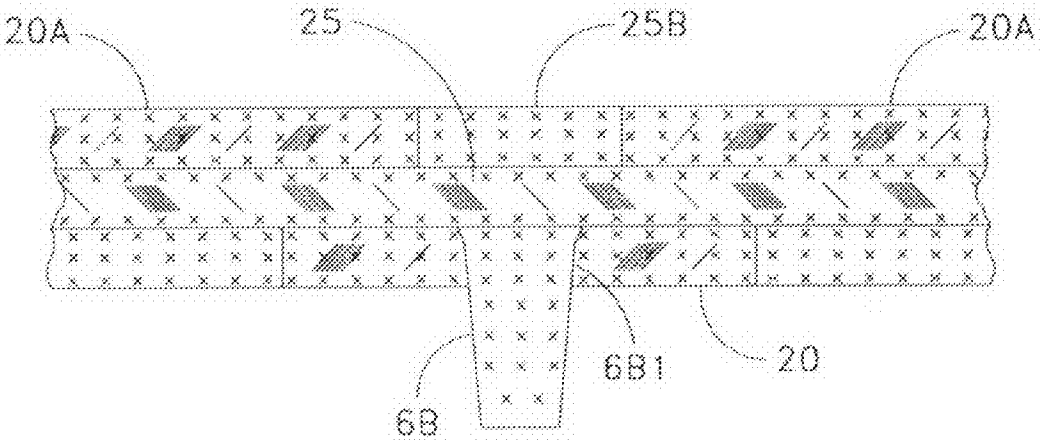
FIG. 6A1

HYBRID TILE METAL MATRIX COMPOSITE ARMOR

CROSS-REFERENCE TO RELATED APPLICATIONS

This application claims the benefit of U.S. Provisional Application No. 61/005,127 filed 3 Dec. 2007.

FIELD OF THE INVENTION

This invention relates to lightweight armor systems in general and more specifically to an integrated, hybrid ceramic tile panel system comprising dense ceramic plate layers combined with metal and/or metal matrix composite (MMC) enveloping structures which include metal rich posts for energy absorption and for attachment of the composite structure to a backing plate.

BACKGROUND OF THE INVENTION

Many different kinds of lightweight armor systems are known and are currently being used in a wide range of applications, including, for example, aircraft, light armored vehicles, and body armor systems, wherein it is desirable to provide protection against bullets and other projectiles. While early armor systems tended to rely on a single layer of a hard and brittle material, such as a ceramic material, it was soon realized that the effectiveness of the armor system could be improved considerably if the ceramic material were affixed to or "backed up" with an energy absorbing material, such as high strength Kevlar fibers. The presence of an energy absorbing backup layer functions to catch the fragments of an incoming projectile but without significantly reducing the spallation of the ceramic caused by impact of the projectile.

Testing has demonstrated that such multi-layer armor systems tend to stop projectiles at higher velocities than do the ceramic materials when utilized without the backup layer. While such multi-layer armoring systems are being used with some degree of success, they are not without their problems. For example, difficulties are often encountered in creating a multi-hit capability armor with multi-layered material structure having both sufficient mechanical strength and ballistic shock resistance as well as sufficient bond strength at the layer interfaces.

Partly in an effort to solve the foregoing problems, armor systems have been developed in which a "graded" ceramic material having a gradually increasing dynamic tensile strength and energy absorbing capacity is sandwiched between the impact layer and the backup layer. An example of such an armor system is disclosed in U.S. Pat. No. 3,633,520 issued to Stiglich and entitled "Gradient Armor System".

The armor system disclosed in the foregoing patent comprises a ceramic impact layer that is backed by an energy absorbing ceramic matrix having a gradient of fine metallic particles dispersed therein in an amount from about 0% commencing at the front or impact surface of the armor system to about 0.5 to 50% by volume at the backup material.

While the foregoing type of armor system was promising in terms of performance, it has been discovered by the present inventors that a dense ceramic armored tile system intimately encapsulated in solid metal and/or metal matrix composites and including cast-in energy absorbing post structures reduces "spallation" caused by projectile impact and has not yet been presented in the art.

SUMMARY OF THE INVENTION

The armor tile system according to the present invention comprises one or more dense ceramic plates encapsulated in solid metal and/or metal matrix composites (MMC) and includes cast-in integrated energy absorbing post structures extending outward from the tile(s). The enveloping aluminum or MMC may contain "reinforcing bars" of strong metal alloy wires to create a re-bar reinforced ductile aluminum or MMC skin, or various configurations of rods or metal sheets, which acts to dissipate energy upon projectile impact while maintaining the structural integrity surrounding the impact zone.

Each individual hybrid tile may comprise a structure of dense ceramic plate(s) and the hybrid tile can be bonded to an aluminum backing plate via extending post structures by methods known in the art such as welding, adhesive bonding, or mechanical swaging. Various arrays of dense ceramic plates, including a single dense plate or a plurality of dense plates may be utilized (1×1, 2×2, 4×4, 2×8, etc) within a hybrid tile and multiple tiles may be mounted to a backing plate depending on the area to be protected.

The armor tile system of the present invention is created utilizing a molten metal infiltration process. First, a mold cavity comprising elongated holes machined into its base is provided. Next, one or more dense ceramic plates are placed within the mold cavity resting on one or more spacers that separate the bottom surface of the ceramic plates(s) from the base of the mold cavity to create a space therebetween. The spacers may be a dense or porous ceramic, or metal or combinations thereof.

The dense ceramic plates are further positioned within the mold cavity to create a controlled space between adjacent plates via alignment spacers positioned between adjacent plates to keep the plates from shifting during metal infiltration. The alignment spacers can be a soft metal or hard ceramic, porous or dense material. The dense ceramic plates and spacers include ceramics which may include open porosity only at the material surface and that are devoid of open interconnected porosity within the interior of the materials.

A mold typically contains one or more ceramic plates however various geometries of flat plates, and combinations of dense layers may be utilized. The mold may further contain metal "rebar" wire or various configurations of rods or metal sheets, placed around the edges of the mold cavity, over the surface of the ceramic plates, and between the plates, to create a reinforced ductile aluminum or MMC skin.

A second set of spacers are next placed on the ceramic plates top surface to create a space between the mold cavity cover and the ceramic plates top surface. A plurality of ceramic plates and spacers may also be stacked according to the shape of the mold cavity and desired ballistic resistance. The mold cavity is next infiltrated under pressure with molten metal allowing for metal to penetrate into any open porosity of the dense ceramic plate layer surfaces and spacer open porosity and through or around areas within the mold cavity that contain open spaces, thereby binding the layers together, and encapsulating the dense ceramic plates and spacers into an integrated tile panel.

The elongated holes in the mold cavity base are also filled with liquid metal that once solidified then form integrated cast-in post structures. These posts may be metal rich or contain other dense or porous ceramic or metal inserts and are provided for energy absorption and attachment of the composite tile structure to a backing plate.

The mold chamber is fabricated to create the final shape or closely approximate that desired of the final product. The hybrid armor tile is next demolded and comprises a hybrid structure of metal matrix composite and ceramic plates with an encapsulating aluminum rich skin and/or metal matrix composite (MMC) enveloping structure. Integrated cast in metal rich post structures are provided for both 1.) energy absorption and 2.) attachment of the composite tile structure to a backing plate. The length, diameter, draft angle and spacing of the posts are variable to meet a desired ballistic threat and blast over-pressure.

A fraction of the posts may be used to attach the composite tile structure to the backing plate, and may be recessed within the backing plate or affixed to the surface of the backing plate. The other fraction of posts being shorter and with post ends either contacting the backing plate, or raised above the backing plate. The attachment posts have a length to allow a separation between the backing plate and the hybrid tile body. The posts help absorb shock and the space between the hybrid tile and backing plate help to deflect an overpressure blast wave.

Additionally, a rubber or adhesive material may be present between the post ends and backing plate and as a filler placed between adjacent posts to further enhance ballistic or blast energy absorption by attenuating shock waves after projectile impact or blast over-pressure.

The dense layers can include an infinite combination of dense material types and geometries. These dense layers may comprise inorganic material systems such as ceramics, metals, carbon/graphite materials, or composites with dense microstructures. Other dense layers include ceramic structures containing interior voids or hollow regions (which are not connected to the surface). The geometries can be in the form of flat plates of varying thickness, compound curved shapes, spheres, cylinders, and of multiple sequences and combinations of the dense materials.

The dense layers are wetted with liquid metal which chemically bonds and/or mechanically infiltrates any open surface porosity and then solidifies and binds the layers together to create a coherent integral structure. The dense layers can be selected according to their denseness and fraction of void volume at the material surface that are to be infiltrated with liquid metal. The selection of different dense material types allows the designer to vary thermal expansion coefficients throughout the structure to create varying stress states for increased effectiveness of the armor tile system. The selection of different material types may also be based on hardness, strength, toughness, and weight attributes of the individual material types desirable for projectile impact protection.

BRIEF DESCRIPTION OF THE DRAWINGS

The invention is best understood from the following detailed description when read in connection with the accompanying drawings, which illustrate an embodiment of the present invention:

FIG. 6A illustrates a sectional view of a demolded hybrid tile panel 60.

FIG. 6A1 illustrates a sectional view of an alternative embodiment of spacer 20 and post 6B of tile panel 60 after metal infiltration.

DETAILED DESCRIPTION OF THE INVENTION

Figure 1:
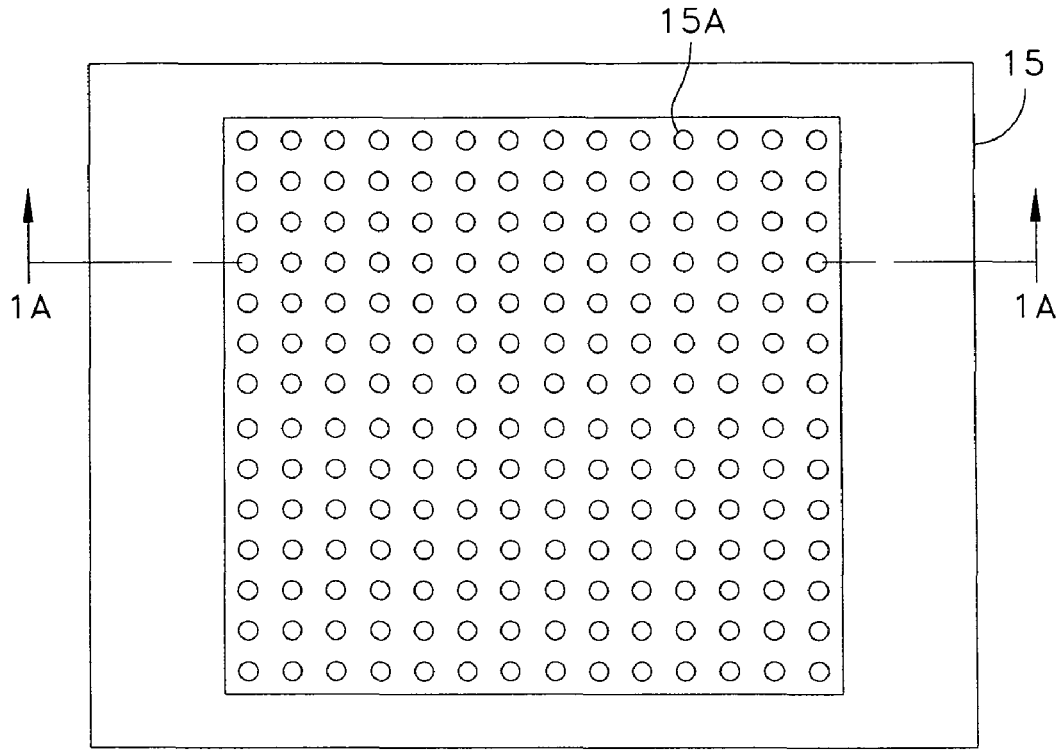
FIG. 1 is a top view of the mold cavity 15 utilized in the production of the armor system of the present invention, illustrating the machined holes for the fabrication of the armor tile post structures.

A hybrid tile armor system 10 of the present invention is illustrated in FIGS. 6 through 10. The system is constructed in accordance with a process heretofore described and as illustrated in FIGS. 1 through 5. First a mold cavity 15 is prepared and is typically made from a die suitable for molten metal infiltration casting with the dimensions defined to produce a hybrid tile armor system.

The dimensions of the mold cavity may be flat or include compound curves required for applications such as personal body armor. Mold cavity 15 includes a plurality of openings 15A milled into mold 15 bottom surface 15B which are subsequently filled with molten metal during the infiltration casting process to form posts 6A and 6B (see FIG. 5) which are integral to and part of containment layer 25B1 and extend outward from spacers 20 and ceramic plates 25 (see FIG. 5) that are placed within the mold cavity 15.

Figure 1A:
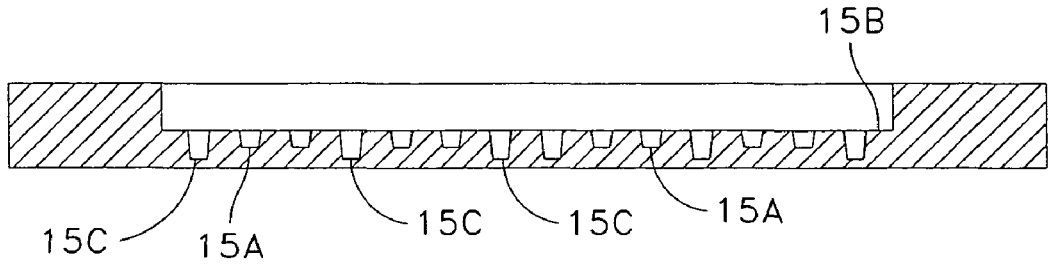
FIG. 1A is a cross-section of FIG. 1 illustrating the varying depth machined holes 15A and 15C.
Figure 2:
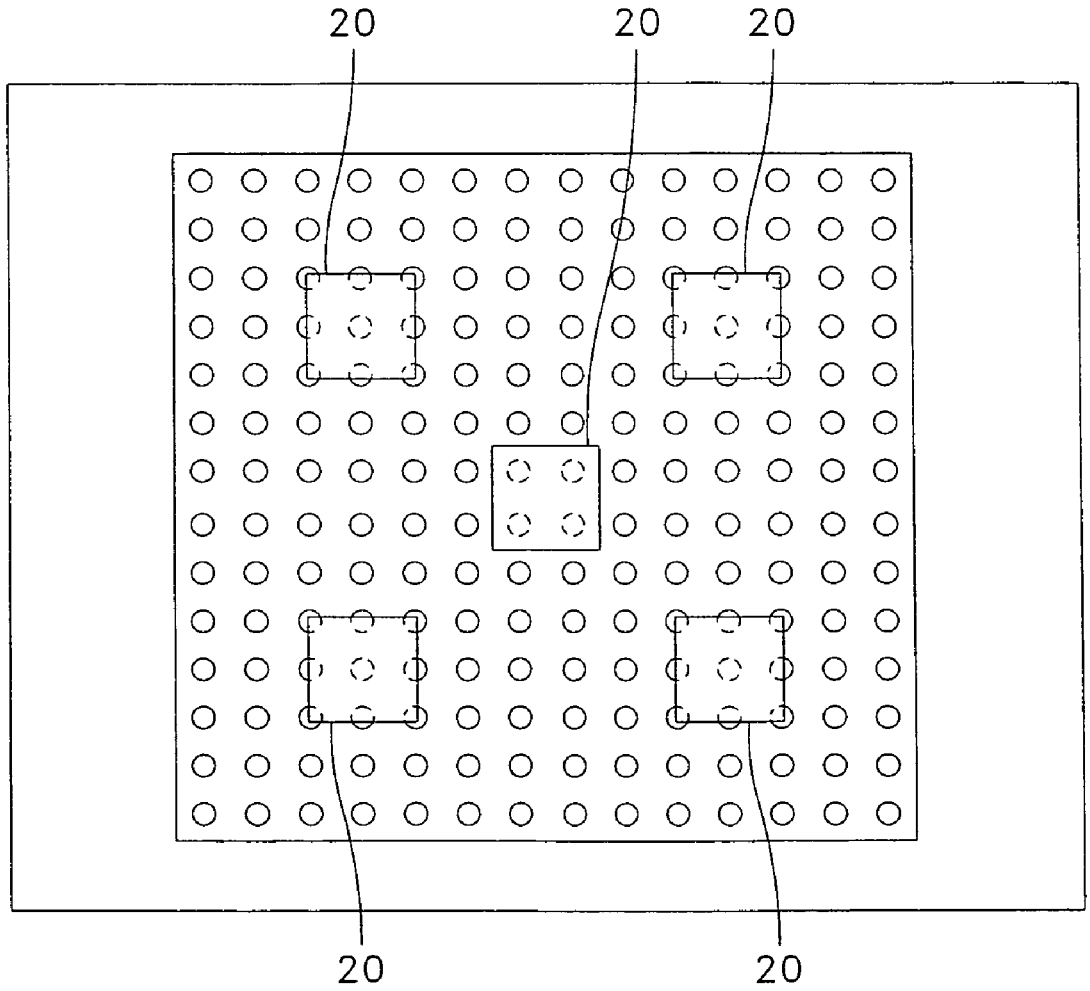
FIG. 2 illustrates the spacers 20 placed within the mold cavity of FIG. 1.
Figure 7:
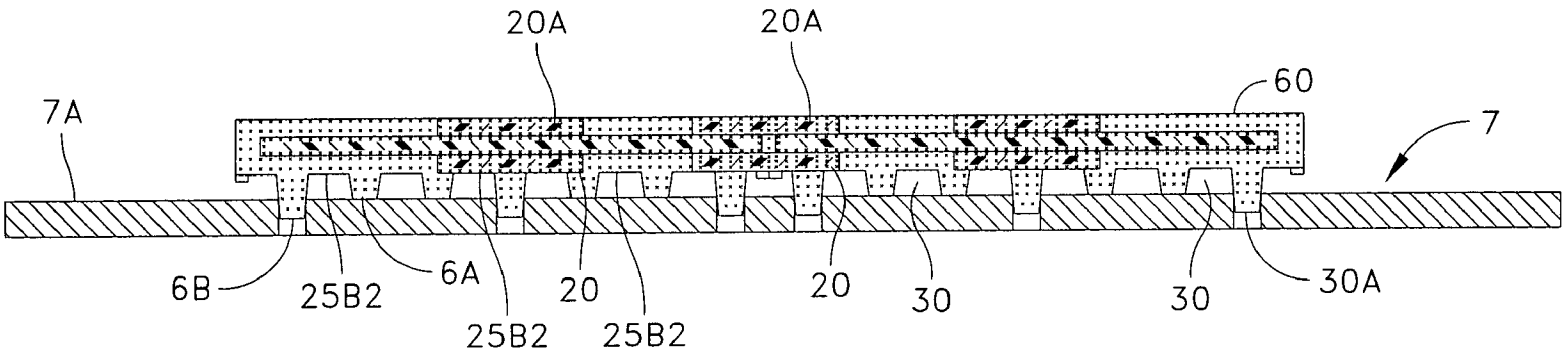
FIG. 7 illustrates the demolded tile panel 60 secured to a backing plate 7.
Figure 7A:
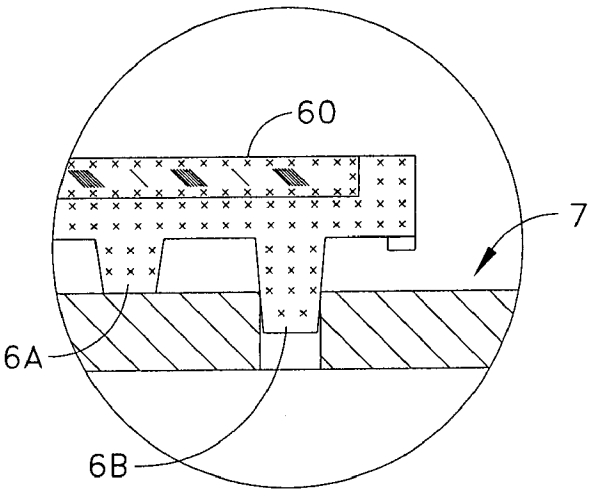
FIG. 7A is an enlarged view of the aluminum plate contact points of FIG. 7 at 6A and 6B.

Referring to FIG. 1A, openings 15A within mold 15 bottom surface 15B may be a fixed length ranging from about 0.020 inches to about 0.5 inches or more but may also include a plurality of longer openings 15C (to form posts 6B) to facilitate bonding of the hybrid armor tile panel 60 to a backing plate 7 as illustrated in FIG. 7. It is also contemplated that the length of openings 15A may be varied throughout the mold cavity 15 according to a particular application requiring either specific length posts for energy absorption requirements or for mounting requirements.

The density of openings 15A could range from about 2% to about 40% of the surface area of bottom surface 15B. It is understood that various arrays of dense ceramic tiles or plates, including a single dense plate or plurality of plates (1×1, 2×2, 4×4, 2×8, etc) may be utilized to form a hybrid tile panel and multiple panels may be mounted to a backing plate to form a larger armor panel structure (see FIG. 7C) depending on the area to be protected. It is further understood that the dimensions, shapes and thicknesses of individual tiles may also be varied according to a particular application.

Referring to FIGS. 1A through 3, a first set of one or more spacers 20, having a total surface area equal to or less than the dense plates 25 surface area, and from about 0.005 inches to about 0.5 inches thickness, is next set on mold 15 bottom surface 15B in a location suitable to uniformly raise the bottom surface of dense plates 25 placed on top of spacers 20 above bottom surface 15B. Typically, the spacers range from about 0.25 inches by 0.25 inches at a minimum but may be larger as required.

The spacers 20 also serve as a reinforcement point to enhance stiffness of the hybrid tile armor tile panel 60 system and may also act to anchor posts 6A and 6B as illustrated in FIGS. 6A and 6A1. Spacers 20 may also include a through hole 6B1 in selected spacer 20 locations covering openings 15A (See FIG. 4) whereby the through hole 6B1 would extend into opening 15A providing a solid post structure that extends into spacer 20 and enhances the bond of posts 6A and 6B to the tile panel 60. Referring to FIG. 6A1, a post 6B is shown with the metal infiltrant extending into a spacer 20 opening or through hole 6B1.

Figure 3:
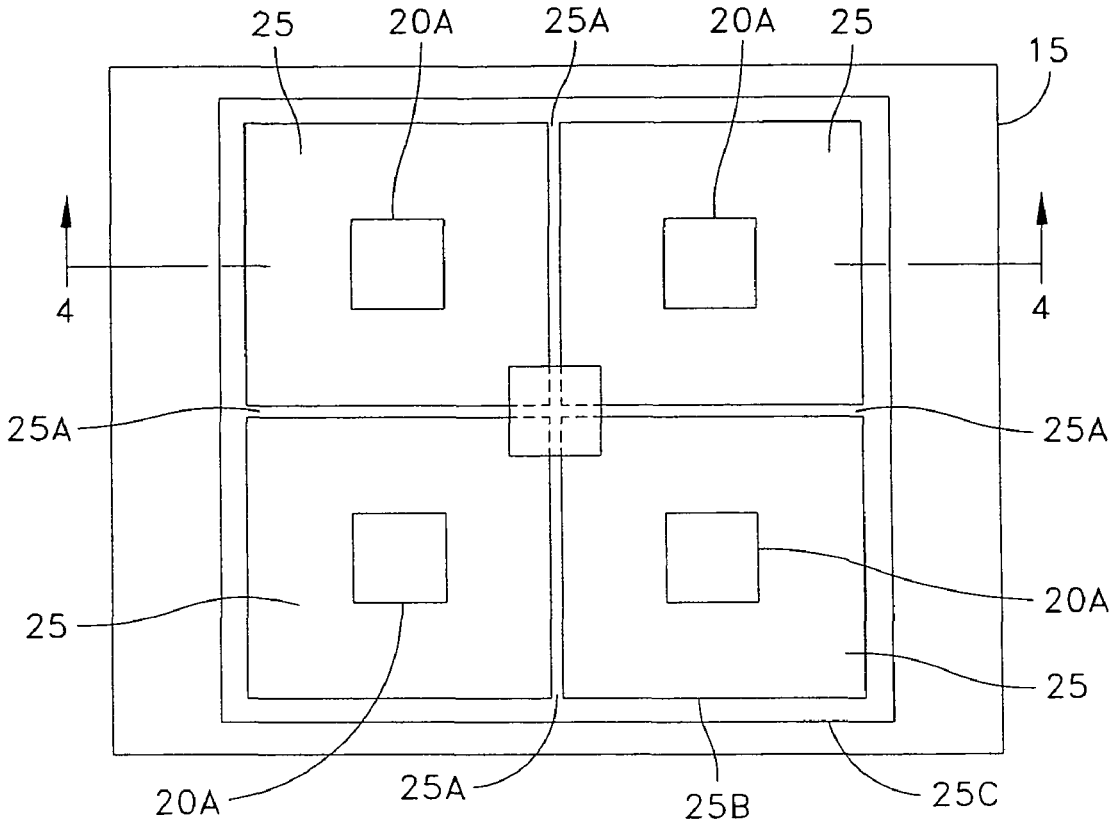
FIG. 3 illustrates the mold cavity 15 of FIG. 2 containing dense ceramic plate inserts 25 stacked on the first set of spacers and a second set of spacers 20A placed on the ceramic plate 25.
Figure 4:
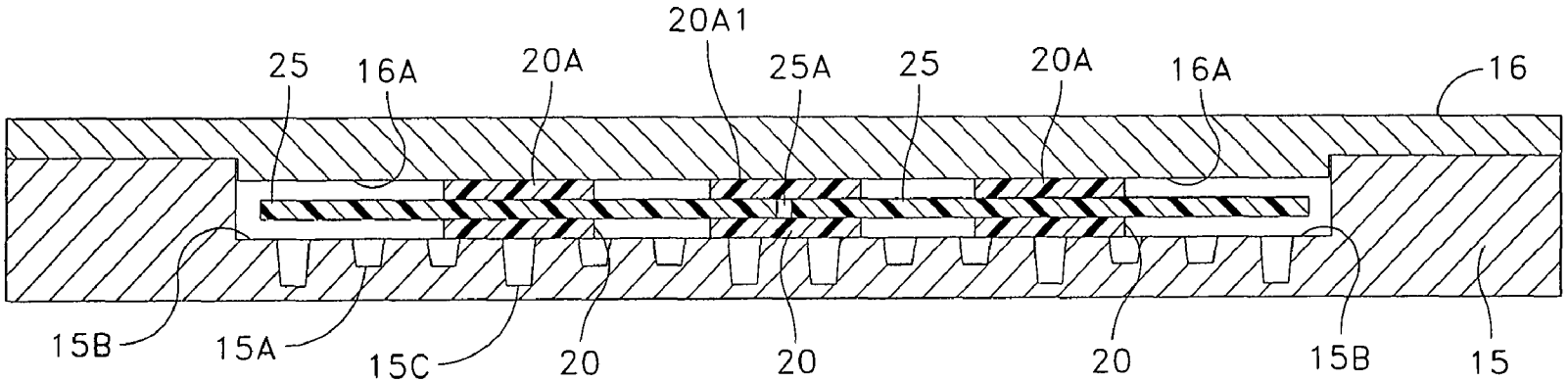
FIG. 4 illustrates a cross-sectional view of the mold cavity 15 prior to molten metal infiltration illustrating a mold cavity cover 16, a layer of spacers 20, a layer of dense ceramic plates 25, a second layer of spacers 20A, and a mold cavity base 15B with machined post cavities 15A and 15C therein.

These reinforced posts can be selected for either posts 6A or 6B according to ballistic threat requirements. Referring to FIG. 3 and FIG. 4, at least one dense ceramic plate 25 is next placed within the mold on top of at least one ceramic spacers 20, with the bottom surface of ceramic plates 25 resting on spacers 20 top surfaces and raising ceramic plates 25 above mold 15 bottom surface 15B approximately 0.005 inches to about 0.5 inches. In the embodiment illustrated in FIG. 3, the mold cavity 15 and tiles 25 placed therein are rectangular, however, it is understood that any dimensioned mold and tile combination is contemplated by the present invention.

The thickness of dense ceramic plates 25 can range from about 0.020 inches to about 2 inches or more. The plates 25 are set in the mold cavity such that space 25A between adjacent ceramic plates is between about 0.01 to about 0.5 inches and the space between the ceramic plate outer periphery 25B and the mold cavity internal side surface 25C is approximately ½ of the space 25A. The controlled spaces 25A defined above and the space between the tile outer periphery 25B and the mold cavity internal side surface 25C is maintained via alignment spacers positioned between adjacent ceramic plates 25 to keep the plates 25 from shifting during metal infiltration. The alignment spacers can be a soft metal or hard ceramic, porous or dense material.

Figure 3A:
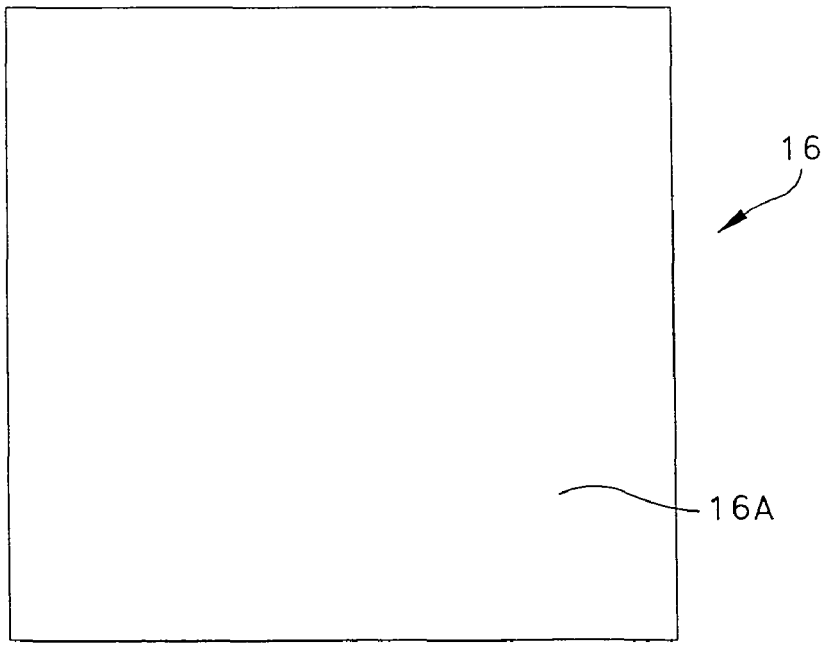
FIG. 3A illustrates mold cavity cover 16 for the mold cavity 15 of FIG. 3.
Figure 3B:
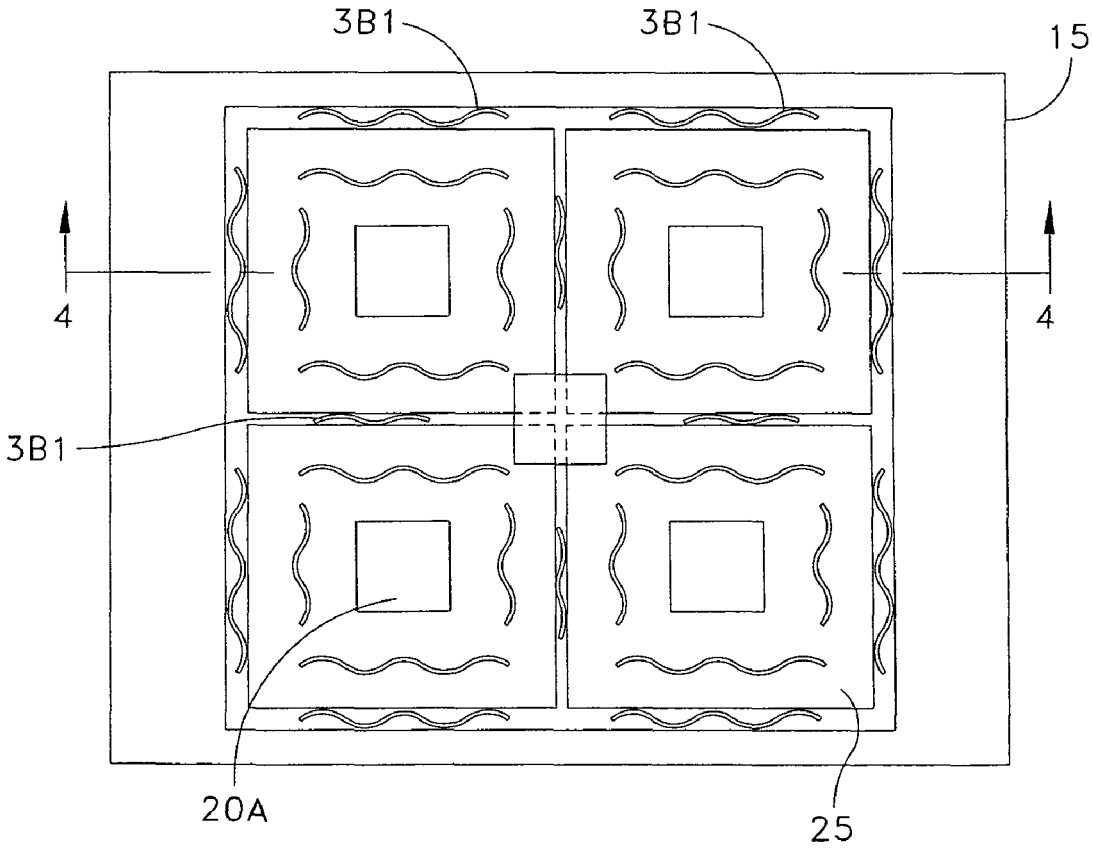
FIG. 3B illustrates the mold cavity 15 of FIG. 3 with rebar reinforcements 3B1 placed therein.
Figure 3C:
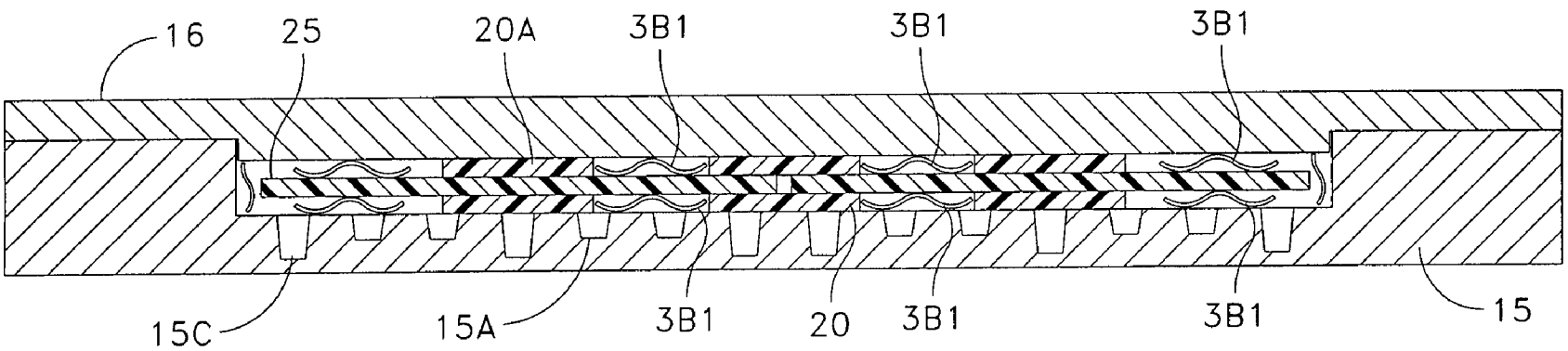
FIG. 3C is a cross-section of FIG. 3B.

Referring to FIG. 3B, wire 3B1 constructed of Ni, or any other alloy of Ni—Fe, Ti, steel, etc, acting as a "re-bar" reinforcement, may be placed on the top surface of ceramic plates 25 and/or in the space between the ceramic plates 25 outer periphery 25B and the mold cavity internal side surface 25C. Referring to FIG. 3C, wire 3B1 may also be placed in open spaces below ceramic plates 25 in a similar manner as illustrated in FIG. 3B. The thickness of wire 3B1 ranges from approximately 0.0005 inches to about 0.5 inches.

Other possibilities contemplated for the "rebar" reinforcement may include various configurations of rods, woven fibers or wires, or metal sheets, placed around the edges of the mold cavity, over the surface of the ceramic tiles, and between the tiles, to create a reinforced ductile aluminum or stiff Metal Matrix Composite (MMC) skin. Next, a second set of one or more spacers 20A are placed upon the top surface of tiles 25, the spacers 20A, which may be of different composition and size than spacers 20, and may be placed directly above and parallel to spacers 20 to aid in the reinforcement, toughness and stiffness of the hybrid tile armor system 60.

Figure 8:
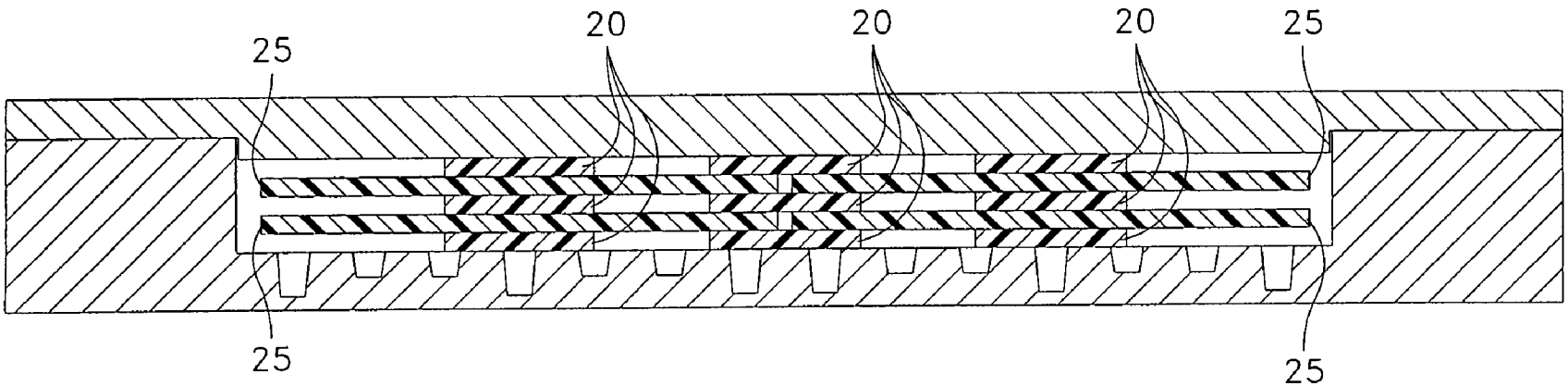
FIG. 8 is a cross section of a mold cavity 15 prior to molten metal infiltration including a plurality of ceramic tiles 25 and spacers 20.

The inventors have found that the alignment of the porous ceramic spacers 20 and 20A can facilitate abrasive type through hole machining. As illustrated in FIG. 8, at least one layer comprising at least one dense ceramic plate 25 may be layered upon each other utilizing at least one layer comprising at least one spacer 20 to create an open space between successive layers prior to metal infiltration. All design features described herein for subject invention apply to an embodiment of subject invention utilizing at least one layer of dense ceramic plates 25 as illustrated in FIG. 8.

Figure 4A:
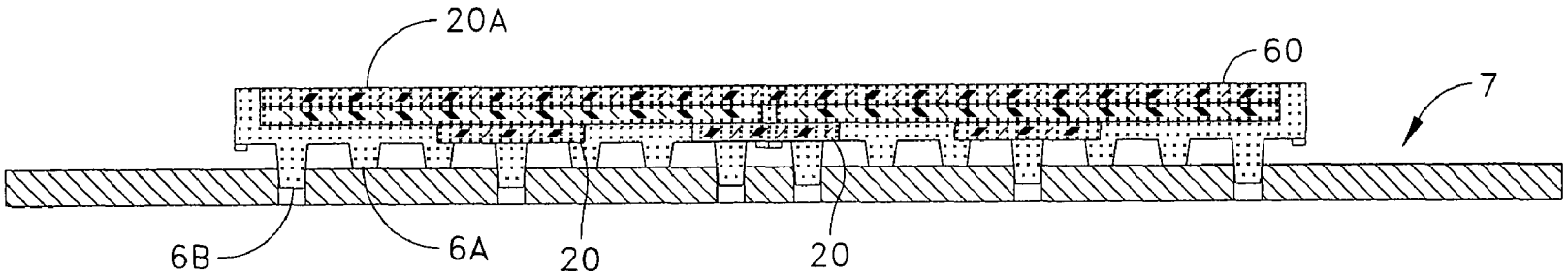
FIGS. 4A and 4B illustrates alternative dimensioned spacers 20 and 20A incorporated in a demolded tile panel 60 after metal infiltration.
Figure 4B:
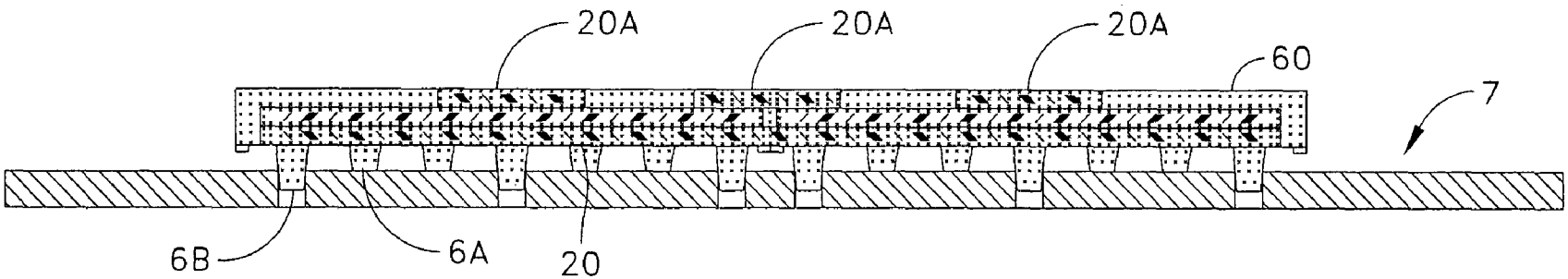
Figure 9:
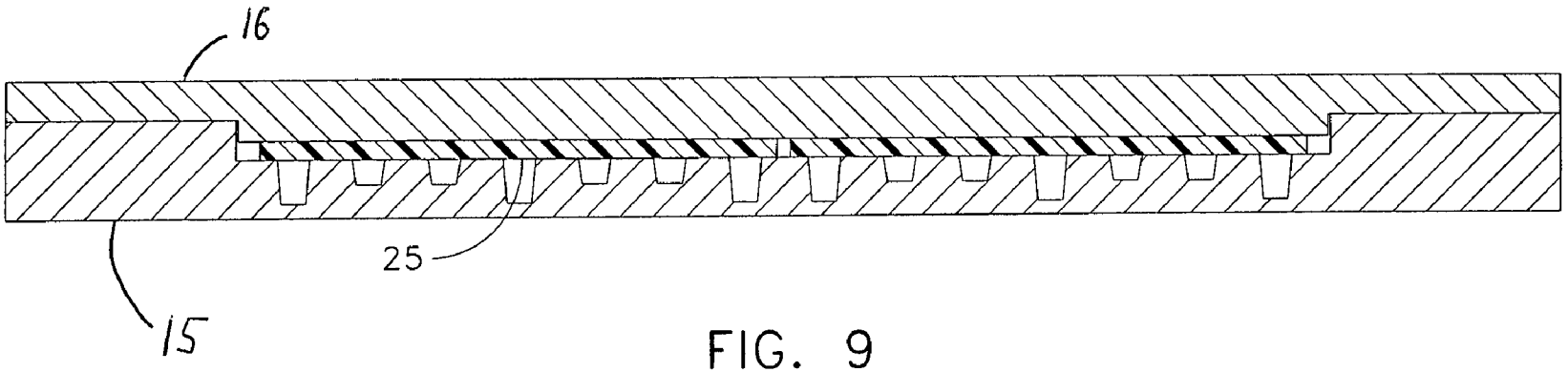
FIG. 9 illustrates a cross section of the mold cavity 15 prior to metal infiltration including a layer of dense ceramic plates 125.
Figure 10:
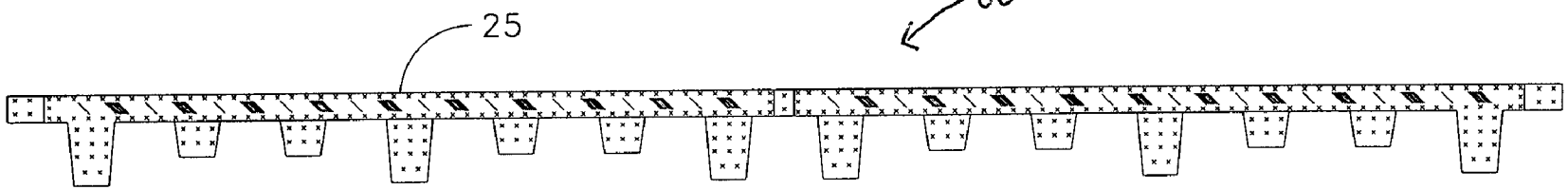
FIG. 10 illustrates a sectional view of the demolded ceramic tile panel 60 after metal infiltration of the mold cavity 15 of FIG. 9.

The number of layers is determined by the mold size and desired ballistic resistance. A cross-section of the stacked layers of dense ceramic plates 25 and stacked layers of spacers 20 and 20A of an embodiment incorporating the principles of subject invention is illustrated in a sealed mold cavity 15 without re-bar reinforcement (FIG. 4) and with re-bar reinforcement (FIG. 3C). It is further contemplated that spacer(s) 20 and 20A may be dimensioned as single material layers covering an entire tile panel surface area (FIG. 4A, 4B) versus single isolated areas as illustrated in FIG. 3. Spacer(s) 20 may also comprise distinct spacer layers mirroring each dense ceramic plate 25. As illustrated in FIG. 9, an alternate embodiment without spacers, and comprising at least one layer having at least one dense ceramic plate is also contemplated. This embodiment includes the placement of at least one layer of dense ceramic plates 25 within the mold 15 but without layers of spacers 20. FIG. 10 illustrates a sectional view of the demolded hybrid tile panel 60 after metal infiltration of the mold cavity 15 of FIG. 9.

Dense ceramic plates 25 comprise a microstructure designed without interconnected porosity and having a predetermined fraction of void volume or open structure at its surface, or zero void volume or open structure at its surface. If a void volume is present it is filled and bonded with molten metal subsequent to metal infiltration casting. Dense ceramic plates 25 may be dense ceramic such as aluminum oxide, silicon carbide, boron carbide, silicon nitride, chemical vapor deposit diamond or composites of ceramics. Dense ceramic plates 25 may be a dense metal such as titanium, tungsten, molybdenum, and depleted uranium or alloys.

Other suitable dense materials include but are not limited to glass-ceramics, and other inorganic material systems which are compatible with molten metal processing and which can contribute to ballistic resistance of the integrated system. Dense materials such as high strength steels, metal alloys, and ceramic alloys may be used in subject invention. Dense ceramic plates 25 include between 0 and 20% surface porosity with the interior of the dense materials not susceptible to metal infiltration.

The dense materials may include "voids" or open spaces within their interior, however, no interconnected porosity is present which would provide a path for metal infiltration from the surface to the interior of dense materials. Spacers 20 and 20A may be ceramic or metal and in the form of particulates or fiber. Spacers 20 and 20A may also be in the form of metal sheets, rods, wires and weaves functioning to separate the ceramic tile layers. The ceramic and/or metal particulate or fiber reinforcements within the metal matrix include materials such as aluminum oxide, carbon, graphite, silicon carbide, boron carbide, titanium, tungsten, nickel, molybdenum, copper, aluminum and other anticipated ceramics or metal materials.

Spacers 20 and 20A having an interior open porosity would range between about 30% and about 90% prior to metal infiltration. Referring to FIG. 3A and FIG. 4, mold cavity cover 16 flat bottom surface 16A is next placed upon spacers 20A top surface defining the closed mold cavity and creating a space between mold cover bottom surface 16A and the top surface of ceramic plates 25 in the areas around spacers 20A. Spacers 20A may be removed when wire 3B1 on the top surface of ceramic plates 25 is utilized and provides a separation between mold cover bottom surface 16A and the top surface of ceramic plates 25. The closed mold cavity is next infiltrated with molten metal.

The Al infiltration process causes aluminum to penetrate throughout the overall structure and into any surface open porosity of dense ceramic plates 25. Spacers 20 and 20A may have a predetermined fraction of void volume or open structure throughout the material structure that becomes filled with molten metal or become bonded metallurgically or mechanically to ceramic plates 25 subsequent to metal infiltration casting.

The Al infiltrant solidifies within and around the material layers extending from one layer interface to the next, thus binding the layers together and integrating the structure. While molten aluminum is the embodiment illustrated other suitable metal infiltrants include but are not limited to aluminum alloys, copper, titanium and magnesium, and other metal alloys cast from the molten liquid phase. The liquid metal infiltration process is described in U.S. Pat. No. 3,547,180 and incorporated herein by reference for all that it discloses.

Referring to FIG. 4, a cross section of the stacked dense ceramic plates 25 and spacers 20 and 20A is illustrated before metal infiltration casting and removal from the closed mold 15 and illustrates the open space around dense material layers of ceramic plates 25 and spacers 20 and 20A. FIG. 4 further illustrates open space within cast-in post structures 15A and 15C of mold 15. FIG. 3C illustrates the cross section of FIG. 4 further including the re-bar reinforcement 3B1. Subsequent to metal infiltration, the metal infiltrant 25B is denoted by the drawing symbol "x", as illustrated in FIGS. 4, 4A, 4B, 5, 6A, 6A1, 7, 7A, and 10.

Figure 5:
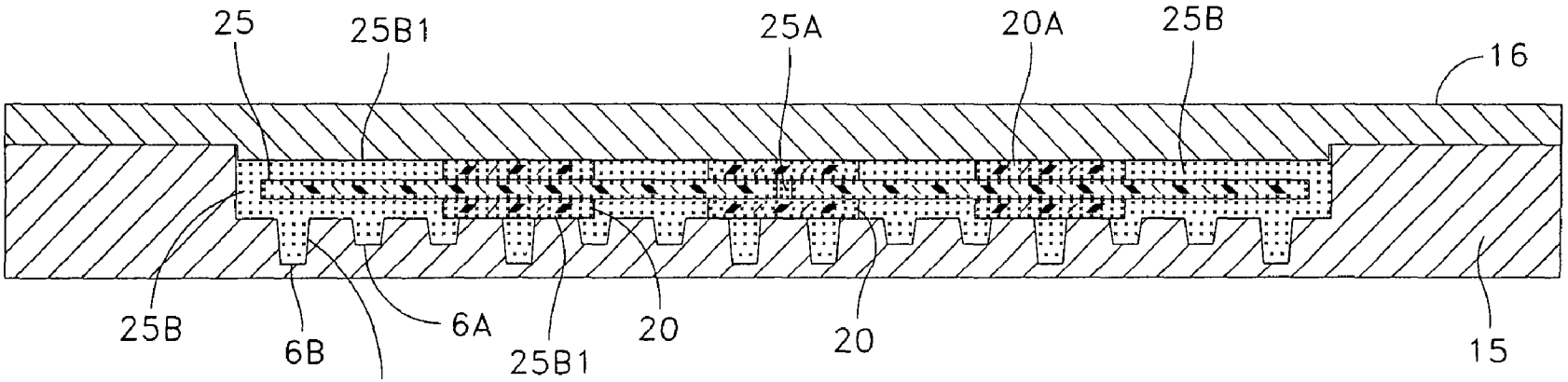
FIG. 5 illustrates a cross-sectional view of the mold cavity of FIG. 4 after molten metal infiltration denoting the molten metal as "x".

Any open surface voids within the dense ceramic plates 25, if present, and open porosity within spacers 20 and 20A are filled with aluminum during the Al infiltration process including space 25A between ceramic plates 25. As illustrated in FIG. 5, mechanical and chemical reactive surface bonding allows the dense ceramic plates 25 to bond at their surfaces at metal infiltrant 25B points "x". The metal infiltrant 25B forms a containment layer 25B1 at the periphery of the molds internal cavity upon completion of the Al infiltration process. Referring to FIGS. 9 and 10 the "X" S denote aluminum penetrating any porosity that may be open at the surface in an otherwise dense (no interconnected porosity) ceramic plate 25. The aluminum forms a thin skin encapsulating the ceramic plate 25, which thickness depends on tolerances and consequent gap between ceramic plate 25 and the mold cavity internal surfaces.

Figure 6:
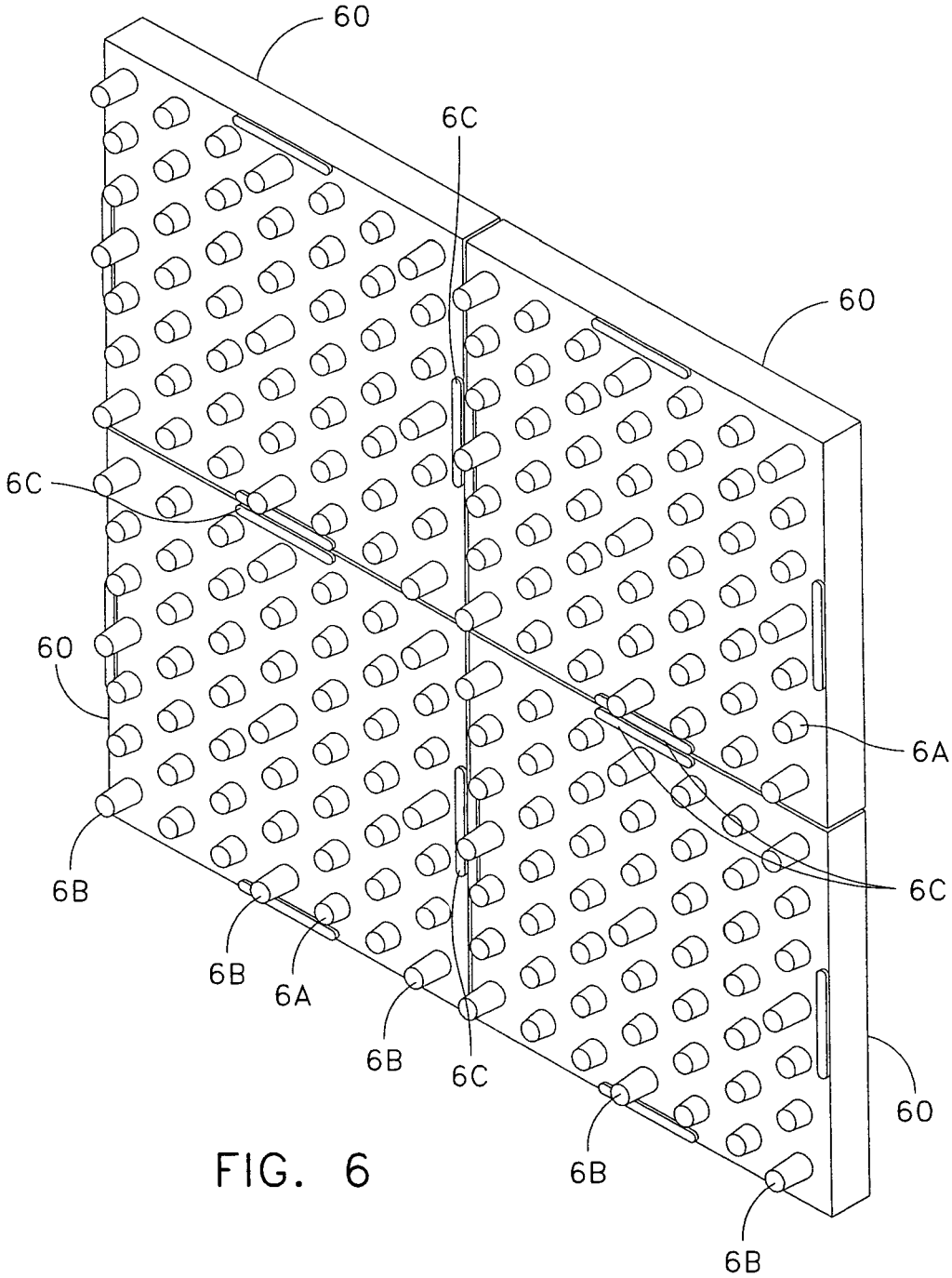
FIG. 6 illustrates a perspective view of four individual demolded tile panel 60 placed adjacent to one another.
Figure 6B:
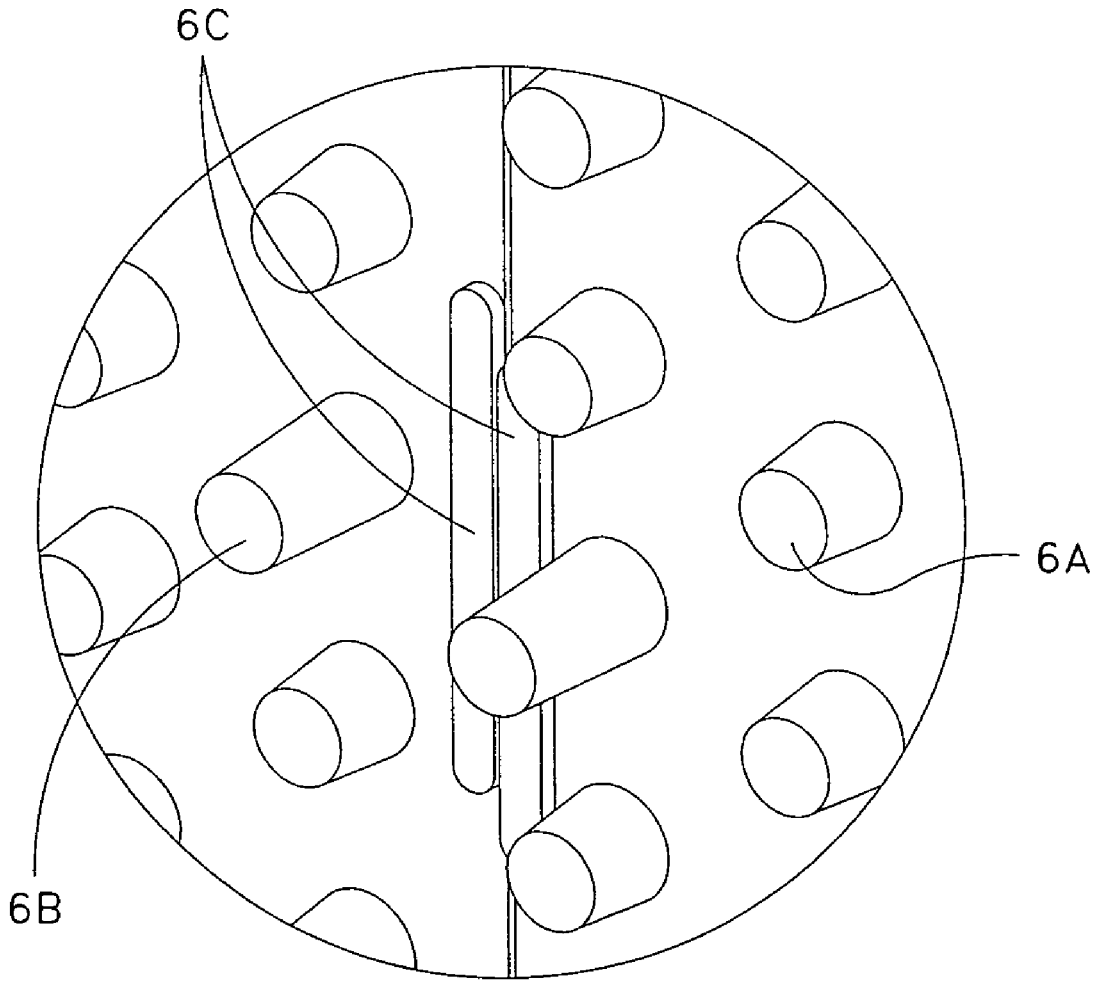
FIG. 6B illustrates a detail view of an example of an aluminum rich rib 6C used for bonding demolded tile panel 60 together.

Referring to FIG. 6, 6A and FIG. 7, after the metal infiltration process is complete the hybrid armor tile panels 60 are removed from the casting mold 15 and may be welded at points 6C and 6B to form a 2×2 array of tile panels 60 to enhance the rigidity of the armor panel structure.

As illustrated in FIG. 7, the backing plate top surface 7A is spaced away from bottom surface 25B2 of hybrid armor tile panels 60 and may be substantially parallel thereto. Tile panel 60 may be welded to a backing plate 7 via elongated posts 6B being recessed into backing plate 7 through a bore formed therein and posts 6B welded within the bore. In the embodiment illustrated, the top of posts 6A would be flush with the top surface of backing plate 7 creating a gap 30 between posts 6A and 6B, the gap acting to deflect or disperse ballistic shock and impact and blast over-pressure. Other possibilities include shorter posts 6A that are raised above the top surface of backing plate 7.

Figure 7B:
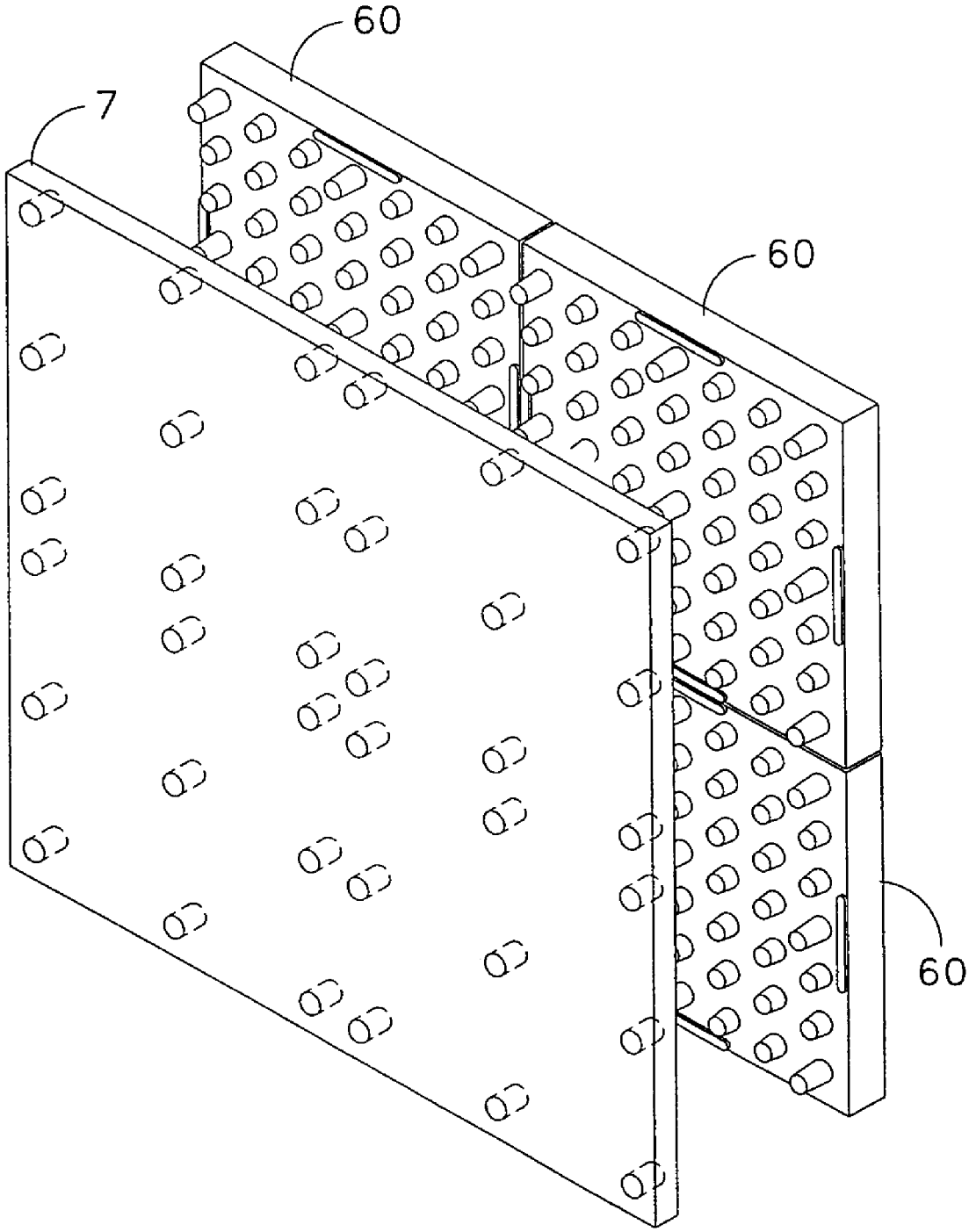
FIG. 7B is a perspective view of four demolded tile panel 60 and backing plate 7.
Figure 7C:
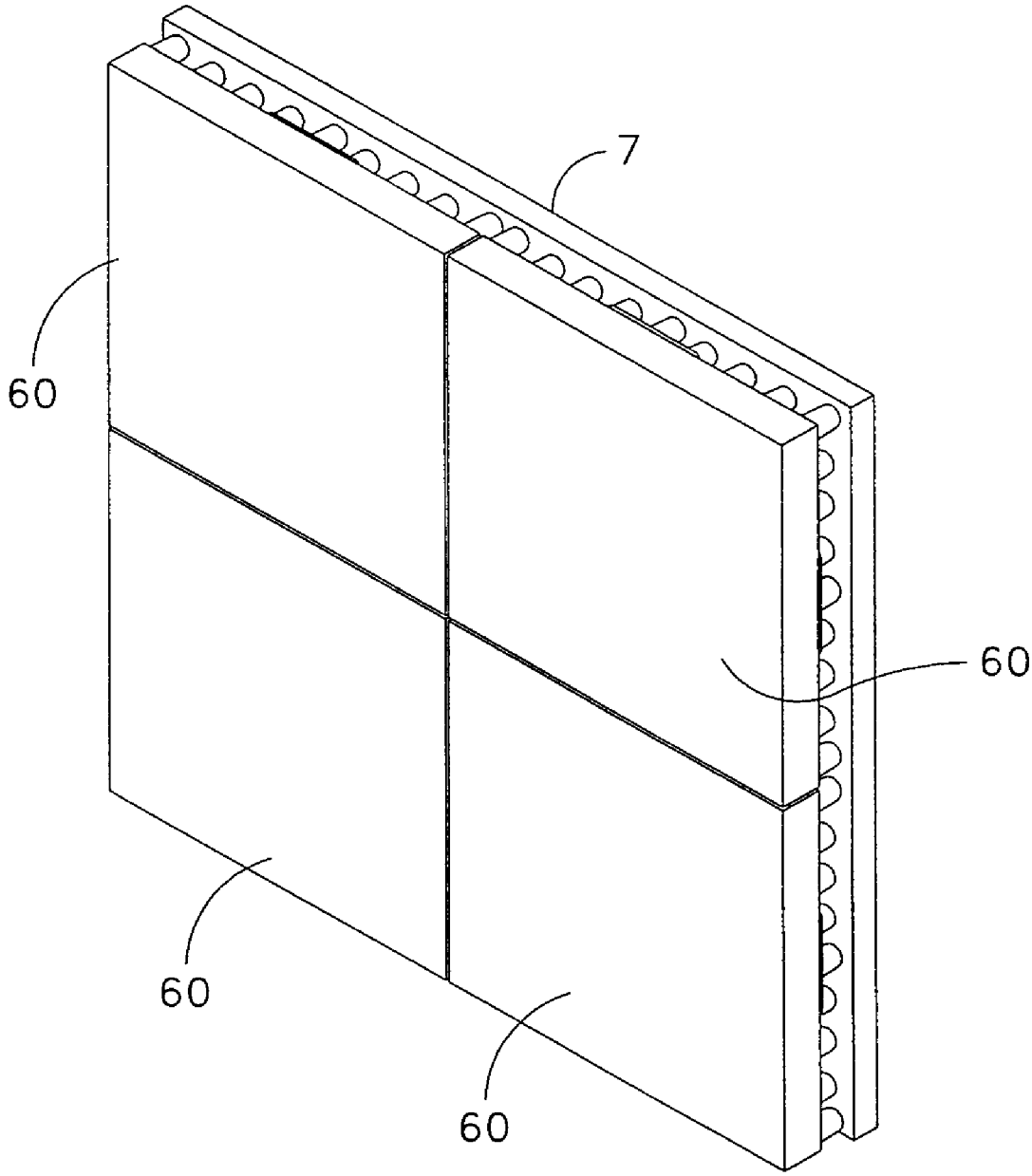
FIG. 7C is a perspective view of the tile panel 60 of FIG. 6 mounted to backing plate 7.

A space 30A may be created below post 6B depending on the depth of the bore into backing plate 7 and extent to which post 6B is inserted into the bore. The backing plate 7 serves as a mounting platform to attach the armor panel to the object requiring protection. The backing plate 7, in combination with armor tile 60, may be made of aluminum, steel, titanium, fiber reinforced epoxy, or other metal or composite structures. As illustrated in FIG. 7B, a plurality of panels 60 may be mounted adjacent each other at a distance from about 0 to about 0.01 inches for optimum ballistic deterrence.

A single backing plate 7 may be drilled itself for attachment of the panel 60 and aligned spacers 20 and 20A may also serve as a drillable medium attachment point.

I claim:

1. A hybrid tile metal matrix composite armor, comprising:

at least one hard layer, each of said at least one hard layer comprising a plurality of dense ceramic plates, said plurality of dense ceramic plates further comprising a spacing therebetween, a containment layer encasing said at least one hard layer, said containment layer formed around said plurality of dense ceramic plates, said containment layer including a plurality of post structures extending outward therefrom, said plurality of post structures including a fixed length plurality of first posts and a fixed length plurality of second posts, and a backing plate, said backing plate including top surface mounting recesses, said mounting recesses engaging said fixed length plurality of second posts up to a point when said fixed length plurality of first posts ends are flush with said backing plate top surface.

2. A hybrid tile metal matrix composite armor as in claim 1, further including:

at least one spacer layer, said at least one spacer layer comprising at least one spacer, said at least one spacer having a fraction of void volume, said at least one spacer further comprising a metal, said metal infiltrated within said void volumes of said at least one spacer, said containment layer encasing said at least one hard layer and said at least one spacer layer, said containment layer formed around said plurality of dense ceramic plates and said at least one spacer, said containment layer including a plurality of integrated post structures extending outward therefrom.

3. A hybrid tile metal matrix composite armor as in claim 2 wherein said at least one spacer layer is positioned as the top layer and the bottom layer of said metal matrix composite armor.

4. A hybrid tile metal matrix composite armor as in claim 1, wherein said plurality of post structures have variable diameters, lengths, and spacings therebetween.

5. A hybrid tile metal matrix composite armor as in claim 1, wherein a space exists between said plurality of short fixed length posts ends and said backing plate top surface.

6. A hybrid tile metal matrix composite armor as in claim 5, wherein said space is filled with rubber.

7. A hybrid tile metal matrix composite armor as in claim 1, wherein the space between said plurality of post structures extending outward from said containment layer are filled with rubber.

8. A hybrid tile metal matrix composite armor as in claim 1, wherein said plurality of post structures have a surface area density from about 2% to about 40% of the surface area of said hybrid tile metal matrix composite armor.

9. A hybrid tile metal matrix composite armor as in claim 1, wherein said spacing between said plurality of dense ceramic plates tiles is from about 0.01 inches to about 0.5 inches.

10. A hybrid tile metal matrix composite armor as in claim 3, wherein the containment layer thickness around the sides of said at least one hard layer is one half of said spacing between said plurality of dense ceramic plates.

11. A hybrid tile metal matrix composite armor as in claim 2, wherein at least one spacer of said at least one spacer layer has a surface area up to and including the surface area of one of said at least one hard layer.

12. A hybrid tile metal matrix composite armor as in claim 2, wherein said at least one spacer are from about 0.005 to about 0.5 inches thick.

13. A hybrid tile metal matrix composite armor as in claim 3, wherein at least one of said at least one spacers of said bottom layer includes a through hole, said through hole infiltrated with metal and integral with said post structures extending outward from said containment layer.

14. A hybrid tile metal matrix composite armor as in claim 2, wherein reinforcement material selected from the group consisting of wire, rods, and metal sheets may be substituted for at least one spacer of said at least one spacer layer.

15. A hybrid tile metal matrix composite armor as in claim 10, wherein reinforcement material selected from the group consisting of wire, rods, and metal sheets may be placed around said sides of said at least one hard layer, over the surface of said at least one hard layer, and between said plurality of dense ceramic plates.

16. A hybrid tile metal matrix composite armor as in claim 15, wherein said wire material has a thickness of from about 0.0005 inches to about 0.5 inches.

17. A hybrid tile metal matrix composite armor as in claim 1, wherein each of said plurality of dense ceramic plates is from about 1 inch by 1 inch in dimension to about 16 inch by 16 inch in dimension.

18. A hybrid tile metal matrix composite armor as in claim 1, wherein each of said plurality of dense ceramic plates have a thickness from about 0.02 inches to about 2 inches.

19. A hybrid tile metal matrix composite armor as in claim 1, wherein said plurality of long fixed length posts are welded into said mounting recesses.

20. A hybrid tile metal matrix composite armor as in claim 1, wherein the space between said plurality of short and long fixed posts is filled with rubber or a similar material.

21. A hybrid tile metal matrix composite armor as in claim 1, wherein a plurality of said metal matrix composite armor is mounted adjacent to each other.

22. A hybrid tile metal matrix composite armor as in claim 21, wherein said adjacently mounted plurality of said metal matrix composite armor are spaced 0 to 0.01 inches apart for optimum ballistic deterrence.

23. A hybrid tile metal matrix composite armor as in claim 2, wherein said at least one spacer layer fraction of void volume prior to metal infiltration is between about 30% and about 80%.

24. A hybrid tile metal matrix composite armor as in claim 2, wherein said at least one spacer layer comprises a reinforcement material selected from the group consisting of ceramic, glass, or glass-ceramic, including oxides and non-oxide ceramics, graphite and carbon formed materials.

25. A hybrid tile metal matrix composite armor as in claim 1, wherein at least one of said at least one hard layer comprises a ceramic material selected from the group consisting of aluminum oxide, silicon carbide, boron carbide, silicon nitride and chemical vapor deposit diamond.

26. An integrated layered armor as in claim 1, wherein at least one of said at least one hard layer comprises a metal material selected from the group consisting of titanium, tungsten, molybdenum, and depleted uranium.

27. A hybrid tile metal matrix composite armor as in claim 1 wherein said backing plate is substantially parallel to said containment layer.

28. A hybrid tile metal matrix composite armor as in claim 1, wherein said spacing between said plurality of dense ceramic plates and said containment layer further comprise a metal therein.

* * * * *

UNITED STATES PATENT AND TRADEMARK OFFICE

CERTIFICATE OF CORRECTION

PATENT NO. : 8,132,493 B1
APPLICATION NO. : 12/220147
DATED : March 13, 2012
INVENTOR(S) : Richard Adams It is certified that error appears in the above-identified patent and that said Letters Patent is hereby corrected as shown below:

IN THE CLAIMS:

Claim 10, Col. 9, Line 13,
Change 3 to 1

Signed and Sealed this
Twenty-ninth Day of May, 2012

David J. Kappos

David J. Kappos
*Director of the United States Patent and Trademark Office*